United States Patent [19]

Eickhoff

[11] Patent Number: 4,969,777

[45] Date of Patent: Nov. 13, 1990

[54] PLATFORM ASSEMBLY AND ACCESSORIES THEREFOR

[75] Inventor: Jon H. Eickhoff, Kalamazoo, Mich.

[73] Assignee: Ronningen Research & Development Company, Vicksburg, Mich.

[21] Appl. No.: 446,921

[22] Filed: Dec. 6, 1989

[51] Int. Cl.[5] ..... E02B 3/20

[52] U.S. Cl. ..... 405/218; 405/195

[58] Field of Search ..... 405/218–221, 405/196, 198, 197, 199, 200; 114/266, 267, 263; 182/179, 180, 222; 14/27, 28

[56] References Cited

U.S. PATENT DOCUMENTS

| | | | |
|---|---|---|---|
| 3,094,848 | 6/1963 | Albrecht | 405/221 |
| 3,096,623 | 7/1963 | Laird | 405/221 |
| 3,620,027 | 11/1971 | Nordell | 405/219 |
| 3,999,397 | 12/1976 | Albery | 182/222 X |
| 4,078,515 | 3/1978 | Svirklys | 114/266 |
| 4,212,564 | 7/1980 | Kay | 405/218 |

FOREIGN PATENT DOCUMENTS

| | | | |
|---|---|---|---|
| 647768 | 9/1962 | Canada | 405/221 |

*Primary Examiner*—Dennis L. Taylor

*Attorney, Agent, or Firm*—Flynn, Thiel, Boutell & Tanis

[57] ABSTRACT

A platform assembly having a pair of separate, laterally spaced and parallel side rails. At least one elongated load supporting structure is provided and is connected to and extends between the side rails. The load supporting structure has a load supporting surface on a top surface thereof and, at opposite longitudinal ends of the load supporting structure, at least a pair of L-shaped flanges. A first of the flanges is adjacent the top surface while a second of the flanges is adjacent a bottom of the load supporting structure. The load supporting structure is coupled to the side rails by first orienting the longitudinal axes of the load supporting structure and the side rails perpendicular to each other and then sliding the load supporting structure onto the side rails. The L-shaped flanges grip around the upper and lower edges of the side rails.

12 Claims, 5 Drawing Sheets

PLATFORM ASSEMBLY AND ACCESSORIES THEREFOR

FIELD OF THE INVENTION

This invention relates to a platform assembly and, more particularly, to a platform assembly adapted for use as a stage, a riser for choirs and orchestras and even boat docks.

BACKGROUND OF THE INVENTION

Platform assemblies have been put to a variety of uses, such as stages, risers for choirs and orchestras and even boat docks. In every instance, assembly procedures have proven to be quite time consuming, particularly where component parts are of differing shapes thereby necessitating the assemblers to be careful to make certain that certain components fit with other components during the assembly task. Further, considerable inventory of components is required in order to make certain that the assembly goes together in a complete manner. It is therefor desirable to provide a platform assembly that utilizes a multitude of identical components each assembleable in a predefined manner so as to render the assemblage easy and less time consuming.

Accordingly, it is an object of this invention to provide a platform assembly that is composed of plural components, many of the plural components being identical with each other and from an assembly using identical components, such as identical components to form the load supporting structure, namely, the platform itself and identical structure for assembling a stair step structure therefor.

It is a further object of this invention to provide a platform assembly, as aforesaid, which is made of a plastics material, preferably recycled plastics so that the platform assembly can be made of inexpensive materials, be resistant to the abusive affects of weather and have a decorative and clean looking appearance.

It is a further object of this invention to provide a platform assembly, as aforesaid, which is easy to assemble, is durably constructed and is capable of repeated assembly and disassembly in a quick and easy manner.

SUMMARY OF THE INVENTION

The objects and purposes of the invention have been met by providing a platform assembly having a pair of separate, laterally spaced and parallel side rails, which side rails have a generally flat plate-like profile which is generally vertically aligned. The plate-like profile has at least three mutually parallel leg portions extending transversely thereto and oriented so as to face the leg portions on the other of the side rails. A first and second one of the three leg portions are spaced so as to define a first channel whereas the spacing between the second and third ones of the three leg portions define a second channel. At least one elongated load supporting structure is provided and is connected to and extends between the side rails. The load supporting structure has a load supporting surface on a top surface thereof and, at opposite longitudinal ends of the load supporting structure, at least a pair of L-shaped flanges. A first of the flanges is adjacent the top surface while a second of the flanges is adjacent a bottom of the load supporting structure. A first leg of each of the first and second flanges extends parallel to the load supporting surface and away from the longitudinal ends. A second leg of the first and second flanges extends generally perpendicular to the first leg adjacent an end of the first legs remote from the load supporting structure. The second legs are co-planar and extend toward one another from their respective first flanges. In addition, there is provided at least one elongated tongue extending away from the longitudinal ends of the load supporting structure and parallel to the first legs. The tongues are located intermediate the first legs. The load supporting structure is coupled to the side rails by first orienting the longitudinal axes of the load supporting structure and the side rails perpendicular to each other and then sliding the load supporting structure onto the side rails, the tongue being received in the first channel. The L-shaped flanges grip around the upper and lower edges of the side rails so that the second flanges are oriented on a side of each of the side rails remote from the load supporting structure extending therebetween.

BRIEF DESCRIPTION OF THE DRAWINGS

Further objects and purposes of the invention will be apparent to persons of ordinary skill in the art upon reading the following specification and referring to the drawings, in which.

Figure 1:
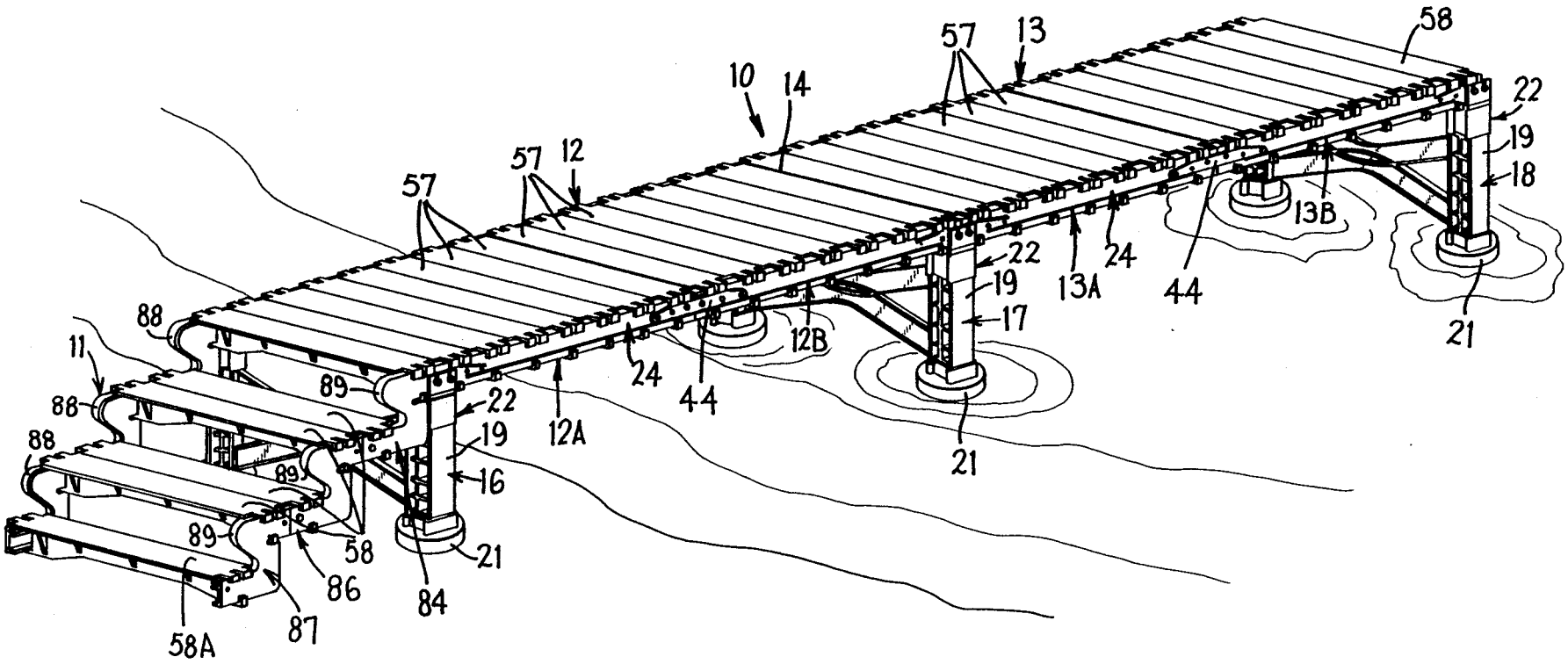
FIG. 1 is a perspective view of a platform assembly, particularly, a second of a boat dock, embodying the invention.

Certain terminology may be used in the following description for convenience in reference only and will not be limiting. The words "up", "down", "right" and "left", if used, will designate directions in the drawings to which reference is made. The words "in" and "out", if used, will refer to directions toward and away from, respectively, the geometric center of the device and the designated parts thereof. Such terminology will include the words above specifically mentioned, derivatives thereof and words of similar import.

DETAILED DESCRIPTION

A platform assembly 10 embodying the invention is illustrated in FIG. 1. The platform assembly 10 is comprised of a plurality of platform sections 11, 12 and 13. The platform sections 12 and 13 are identical and are joined end-to-end, as at 14 illustrated in FIG. 1. The platform section 11 is in the form of a stair step leading to an elevated arrangement of the platform sections 12 and 13. In this particular embodiment, the platform sections 11, 12 and 13 are supported on cross brace assemblies 16, 17 and 18. In this particular embodiment, the cross brace assemblies 16, 17 and 18 are identical and include a cross brace member 19 supported on pods 21 which are adapted to be supported on a supporting surface, such as the ground. It is also included in this invention that the pods can rest on the floor of, for example, an exhibition hall and the platform sections 11, 12 and 13 can be used in conjunction with, for example, an elevated display in the exhibition hall. However, and is illustrated in FIG. 1, the platform sections 11, 12 and 13 are used in conjunction with a boat dock, but such illustrated usage is not to be limiting.

A height or level adjusting device 22 is positioned intermediate the cross brace members 19 and the ends of the platform sections 11, 12 and 13. Further details concerning the design of the cross brace members 19 are illustrated in a copending design application Ser. No. 07/446,918 filed Dec. 6, 1989 entitled CROSS BRACE. In addition, further details concerning the construction of the height or level adjusting devices 22 are illustrated in a copending application Ser. No. 07/446,920, filed Dec. 6, 1989, entitled Height or Level Adjusting Device For Platform Assembly. Reference to this latter application is to be incorporated herein.

A design application Ser. No. 07/446,917, filed Dec. 6, 1989, entitled PLATFORM ASSEMBLY, shows further design details of the platform assembly 10. However, and in addition to the aesthetic appearance of the platform sections 12 and 13, inventive detail is present in the aforementioned platform sections and hence the following detailed description thereof is being set forth.

Figure 3:
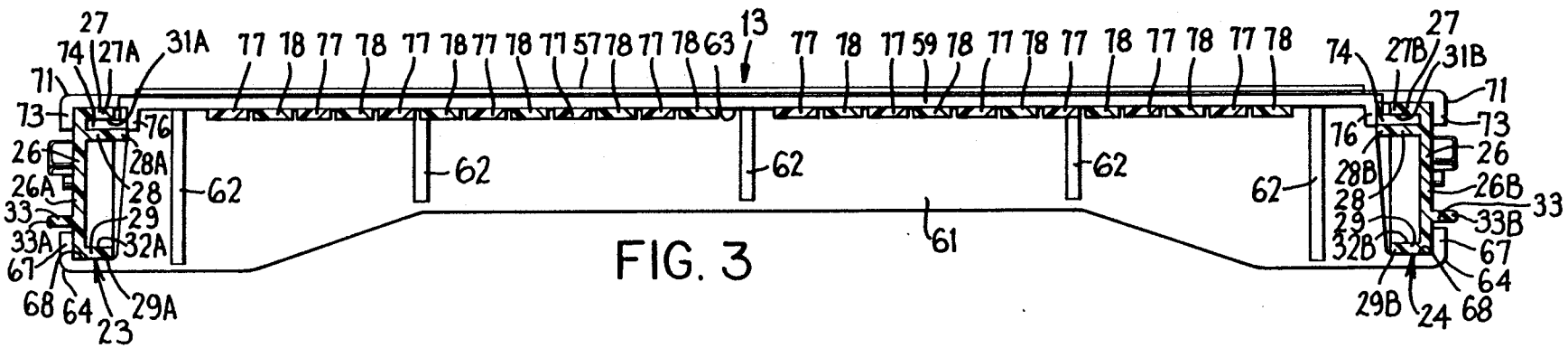
FIG. 3 is a sectional view taken along the line 3—3 in FIG. 2.

As is illustrated in FIG. 3, a pair of parallel extending side rails 23 and 24 are provided and extend lengthwise of the platform assembly as is illustrated in FIG. 1. Each of the side rails 23 and 24, in this particular embodiment, are of identical cross section and of an identical length. In fact, the entire construction of the side rails is identical and, as a result, they can be used interchangeably on either the left side or the right side of the platform assembly. Since the side rails 23 and 24 are identical, the component parts thereof will be identified by the same reference numerals except that the drawings will show the component parts for the side rail 23 with the suffix "A" and the component parts for the side rail 24 with the suffix "B".

Figure 6:
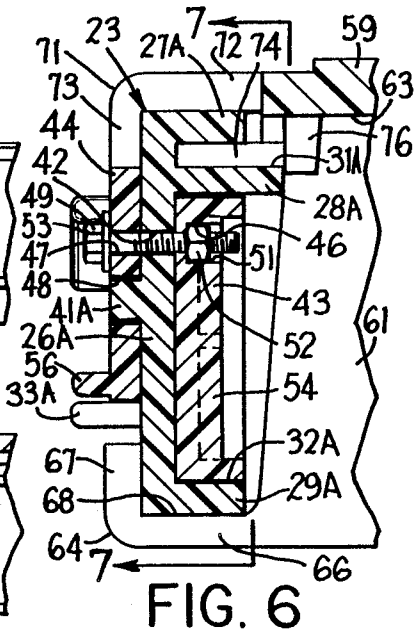
FIG. 6 is a sectional view taken along the line 6—6 of FIG. 5.

Each of the side rails includes a flat plate-like profile 26 which is generally vertically aligned. The flat plate-like profiles 26 each have at least three mutually parallel legs 27, 28 and 29 extending transversely thereto, in this particular embodiment perpendicular to the plane of the flat plate-like profile 26. As is illustrated in FIG. 3, the legs 27, 28 and 29 of one side rail are coplanar with the corresponding leg portions of the other laterally spaced side rail and are oriented to face the legs on the aforesaid other side rail. Referring more specifically to FIG. 6 and the enlarged illustration of a cross section of a side rail 23, the spacing between the legs 27A and 28A define a channel 31A whereas the spacing between the legs 28A and 29A define a channel 32A. Similarly, the spacing between the legs 27B and 28B define a channel 31B and the spacing between the legs 28B and 29B define a channel 32B.

Each platform section 12 and 13 is comprised of a pair of smaller platform sections 12A, 12B and 13A, 13B, respectively. The length of the side rails 23 and 24 each correspond to the length of the smaller platform sections. The platform sections 12A and 12B are identical to the platform sections 13A and 13B. For convenience, the platform sections 13A and 13B will be described in further detail, it being understood that the description will be applicable to the platform sections 12A and 12B.

Figure 5:
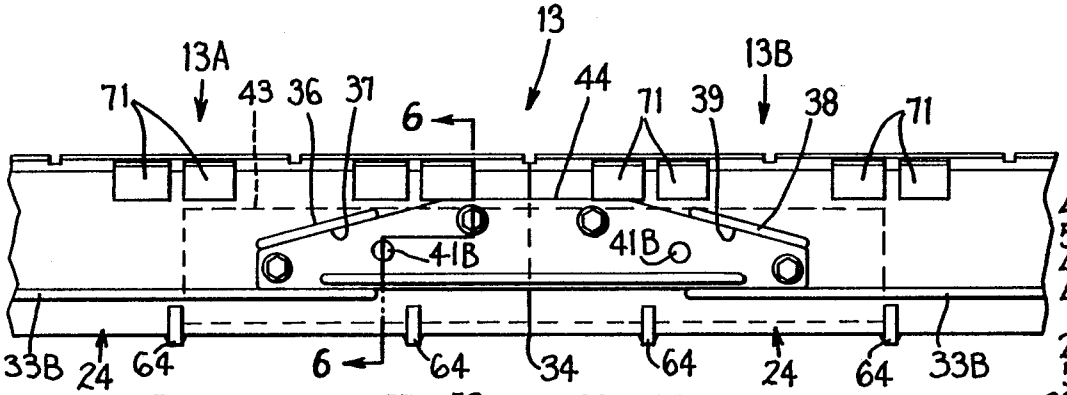
FIG. 5 is a fragmentary and enlarged side view of a pair of platform assemblies that have been joined together.

The side rails 23 and 24 utilized in the smaller platform sections 12A and 12B are each joined end-to-end to other sides 23, 24, as illustrated in FIG. 5. As is illustrated in FIG. 3, each side rail includes a laterally outwardly extending flange 33 which, when the side rails are joined end-to-end, are oriented in a coplanar-like manner. The flanges 33 terminate short of the ends 34 of the respective side rails. A further laterally extending flange 36 is provided above the right end (FIG. 5) of the left side rail, which flange is inclined to the horizontal so as to define a diverging channel 37 opening toward the end 34 of the respective left side rail 24 illustrated in FIG. 5. Similarly, a further laterally extending flange 38 is provided adjacent the left end of the right side rails 24 immediately above the flange 33B and is inclined to the horizontal so as to define a diverging channel 39 opening toward the left end of the right side rail. In addition, a raised circular boss 41 is provided intermediate the flanges 33, 36 and 33, 38, as illustrated in FIGS. 5 and 6. In this particular embodiment, the raised bosses 41 lie on an approximate bisector of the diverging angle formed between the respective flanges 33 and flanges 36 and 38. In addition, a plurality of bolt receiving openings 42 are arranged in an identical pattern at the respective longitudinal ends of the side rails 23 and 24.

The end rails 23 and 24 are joined together by a pair of fishplates 43 and 44. The fishplate 43 extends across the juncture 34 between the ends of a pair of mutually adjacent side rails as illustrated in broken lines in FIG. 5. A plurality of bolt holes 46 are provided in the fishplate 43 and are oriented in a pair of patterns that are identical to the pattern of bolt holes 42 in the left and right ends of the side rails 23, 24. As illustrated in FIG. 6, the fishplate 43 is received in the channels 32, such as the channel 32A illustrated in FIG. 6, it being noted that the fishplate 43 contacts the legs 28 and 29, such as the legs 28A and 29A illustrated in FIG. 6. Once inserted into the channels 32, the pair of patterned bolt holes 46 become aligned with the bolt holes 42 in the mutually adjacent ends of the side rails.

In addition, the fishplate 44 is received into the diverging channels 37 and 39 on the outwardly facing side of the side rails as best illustrated in FIG. 5 and 6. The fishplate 44 has, like the fishplate 43, a plurality of bolt holes 47 oriented in a pair of patterns that are identical to the patterns that are provided on the fishplate 43. In addition, a pair of longitudinally spaced holes 48 are provided amongst each of the patterns of bolt holes on the fishplate so as to be adapted to receive therein the raised bosses 41 as illustrated in FIGS. 5 and 6. As illustrated in FIG. 5, one edge of the fishplate 44, namely, the upper edge has an inclined surface at each end thereof so as to render the opposite ends receivable in the diverging channels 37 and 39. Once in the channel, the holes 48 will receive therein the raised bosses 41 and the pair of patterned bolt holes will virtually be automatically aligned with the bolt holes 42 and 46 in the side rails and fishplate 43. Fastening members 49 are received in the aligned bolt holes as shown in FIG. 6. In this particular embodiment, the fishplate 43 has an enlarged countersunk portion 51 adapted to snugly receive therein a nut 52 and is adapted to hold the nut fixed as the bolt portion 53 is turned with respect thereto. Thus, during assembly and disassembly, there need be no concern about the loss of nuts as they will remain present on the fishplate 43.

Figure 7:
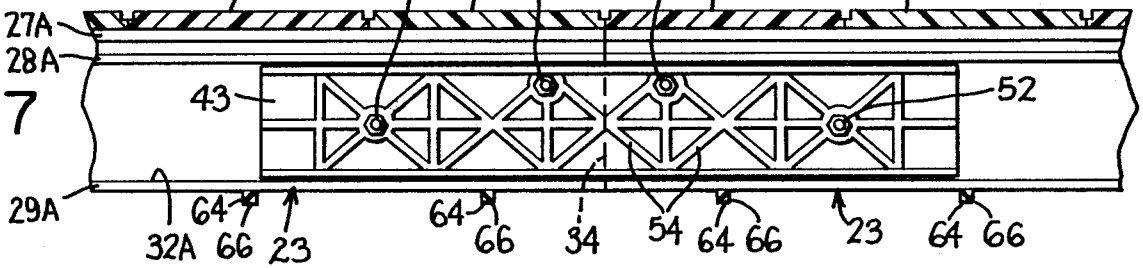
FIG. 7 is a sectional view taken along the line 7—7 of FIG. 6.

As is illustrated in FIGS. 6 and 7, the fishplate 43 is essentially U-shaped in cross section having a plurality of rigidifying webbing 54 extending between the legs of the U-shaped profile. This strengthening of the fishplate 43 enhances its ability to adequately support the juncture 34 between the mutually adjacent ends of the side rails 23, 24. In addition, a laterally outwardly extending flange 56 is provided on the fishplate 44 adjacent the lower edge thereof to enhance its ability to resist bending forces that may occur as a result of loads applied at the juncture 34 between the mutually adjacent ends of the side rails 23, 24.

Prior to assembly of the side rails in the above-discussed end-to-end arrangement shown in FIGS. 5 and 6, it is desirable to first install a plurality of load supporting members 57 onto the side rails 23, 24. A further load supporting member 58 of a slightly different construction is provided at a free end of the platform assembly, such as the platform assembly illustrated in FIG. 1, and on the stair step assembly comprising the platform section 11. A copending design application Ser. No. 07/446,920 entitled PLATFORM SUPPORT PIECE, filed Dec. 6, 1989, illustrates other design features of the load supporting members 57 and 58. The inventive structural details of these two load supporting members will now be set forth.

Figure 4:
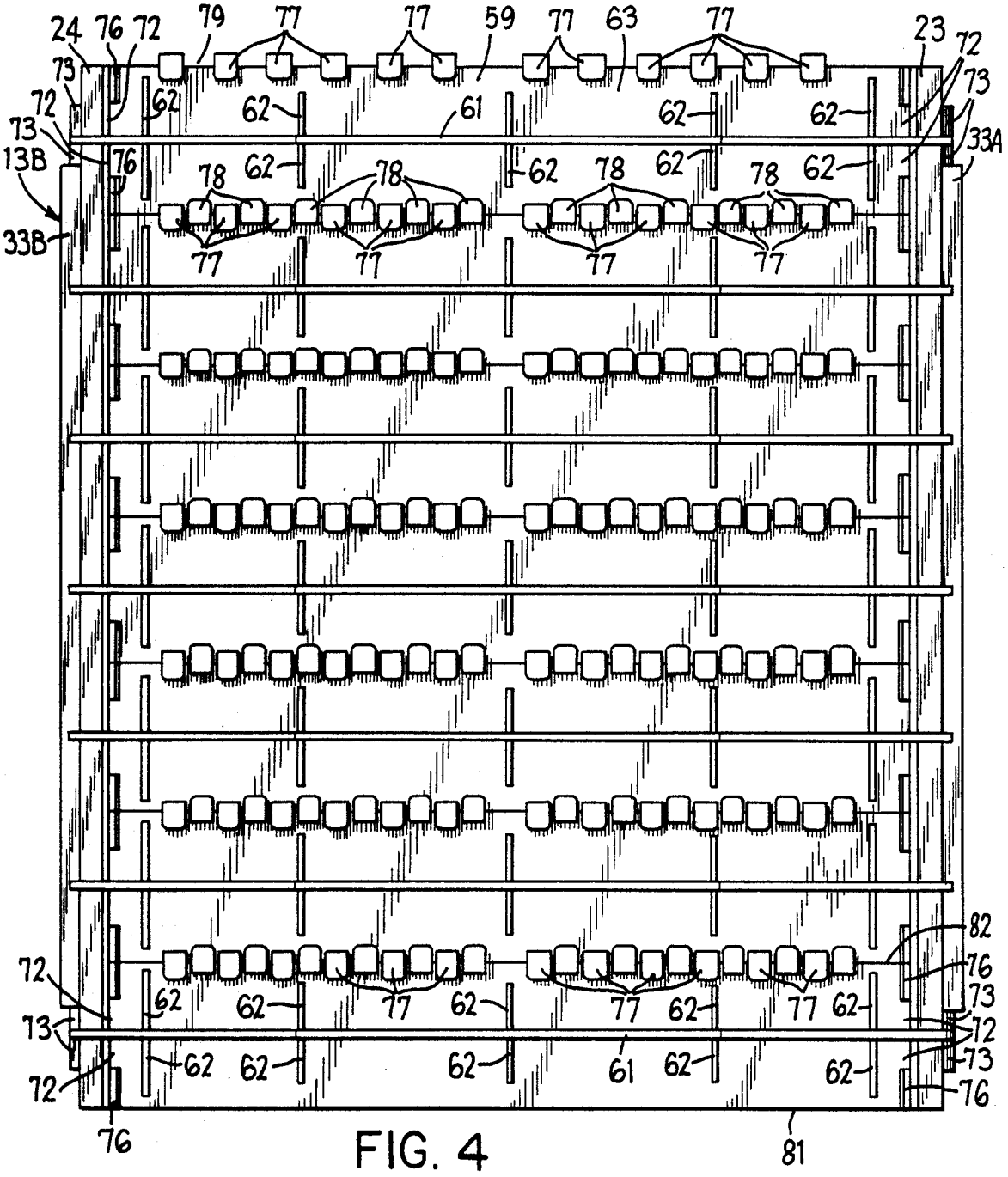
FIG. 4 is a bottom view of the illustration in FIG. 2.

The load supporting members 57 are identical with each other and, therefore, a description of one will be deemed applicable to the remainder thereof. In this particular embodiment, each load supporting member 57 has a generally T-shaped cross section, namely, a generally horizontally aligned plate section 59 and an upstanding, vertically aligned stem 61. A plurality of flanges 62 extend perpendicularly away from the stem 61 on opposite sides thereof along the length of the load supporting member 57. The flanges 62, at their upper end, are integrally formed to the underside 63 of the plate 59. Further, the flanges can have various lengths extending perpendicularly away from the stem 61 as well as away from the underside 63 of the plate 59 as best illustrated in FIGS. 3 and 4.

In this particular embodiment, the stem 61 terminates at opposite ends in an L-shaped flange 64. A first leg 66 of the flange 64 extends generally horizontally away from each end of the stem 61 and terminates in a second leg 67 which extends upwardly therefrom. The spacing between the terminal ends of the stem 61 and the upwardly turned legs 67 of the flanges 64 each define a channel 68 adapted to receive therein a corresponding one of the side rails 23, 24. The stem 61 is preferably centrally located along the width of each of the load supporting members 57.

Figure 2:
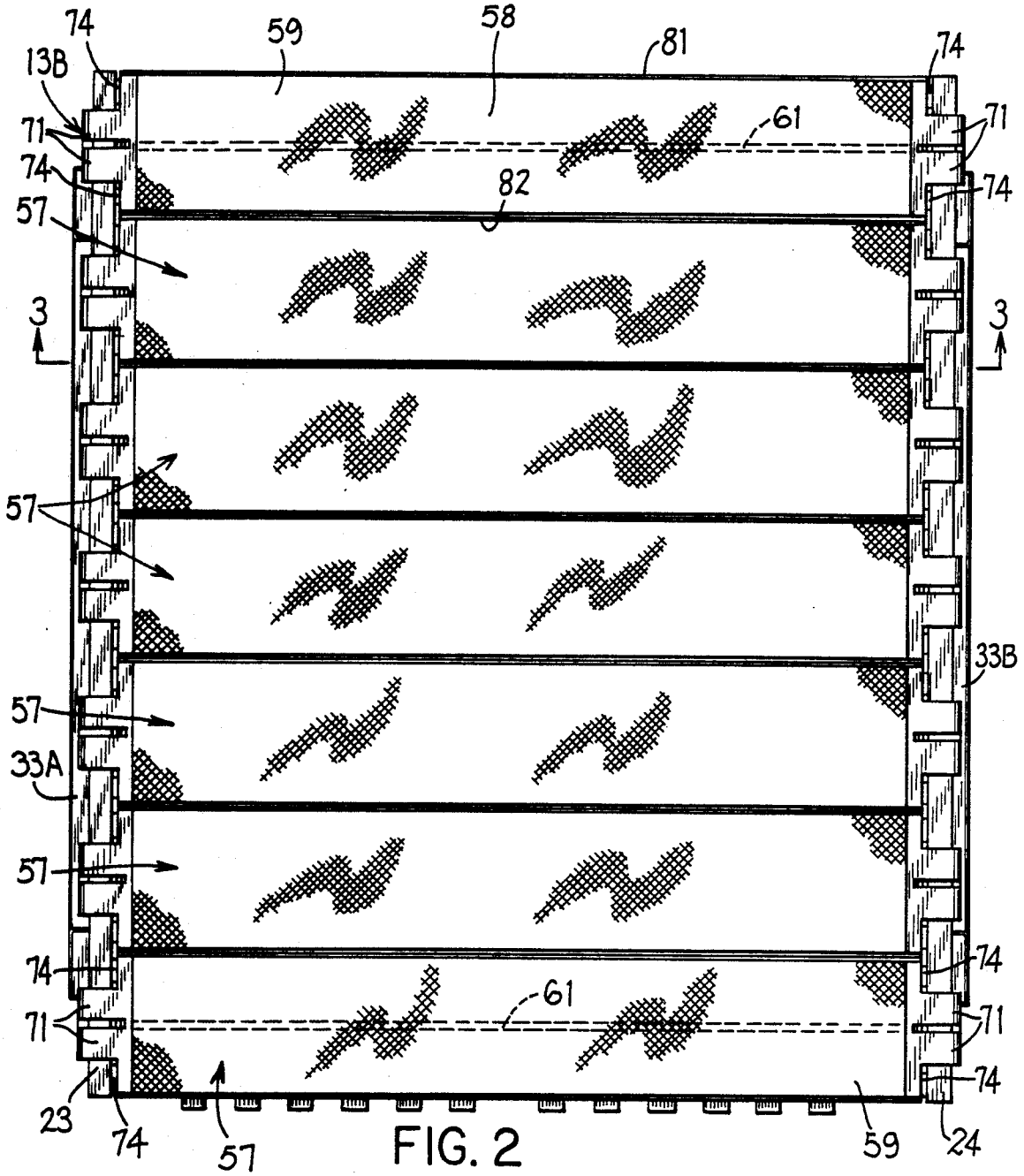
FIG. 2 is a top view of a section of the platform assembly.

A pair of L-shaped flanges 71 extend away from both ends of the plate portion 59 and are oriented on opposite sides of the stem 61 as shown in FIG. 2. The longitudinal axis of each of the flanges 71 extends generally parallel to the longitudinal axis of the stem 61. Each flange 71 has a leg 72 which is integrally formed to the ends of the plate 59 and an end remote thereto terminates in a leg 73 extending downwardly therefrom. The leg 73 is generally coplanarly aligned with the upstanding leg 67 of the flange 64. The corner defined by the legs 73 and 74 of the flange 71 is adapted to receive an upper corner of a corresponding one of the side rails 23, 24 as illustrated in FIG. 6.

A pair of tongue members 74 are also provided and are mounted on a mounting block 76 which extends downwardly from the underside 63 of the plate 59 as shown in FIG. 6. The tongues 74 project from the mounting block 76 in a direction that is parallel to the leg 72 of the flange 71. As is shown in FIG. 2, the tongues 74 at each end of the load supporting member 57 are oriented on opposite sides of the pair of flanges 71 and, as shown in FIG. 6, are oriented in a plane that is spaced below the plane of the flange 72. In this particular embodiment, the underside of the tongue 74 is generally coplanar with the terminal end of the leg 73 of the flange 71. The spacing between the flange 72 and the top surface of the tongue 74 corresponds, generally, to the thickness of the leg 27 of the side rails 23, 24.

A plurality of tabs 77 and 78 are provided along opposite edges of the plate portion 59 of the load supporting member 57. Further, the tabs 77 along one edge are offset from the tabs 78 along the opposite and parallel edge of the plate 59. As is illustrated in FIG. 4, the tabs extend parallel to the longitudinal axis of a platform section 12, 13 and extend beyond the edges of the load supporting member 57. The space 79 (FIG. 4) between mutually adjacent tabs 77 on one edge is adapted to receive therein a tab 78 from the next mutually adjacent load supporting member 57. The upper surface of each of the tabs 77, 78 are adapted to engage the underside 63 of the plate 59 of the load supporting member 57, as illustrated in FIG. 3.

To assemble a plurality of load supporting members onto the side rails 23, 24, a side rail is inserted into the channels 68 defined by the flanges 64 at the opposite ends of each load supporting member 57. Similarly, the side rails 23, 24 will be received into the channel defined by the flanges 71 and, simultaneously, the tongues 74 will be received in the channels 31. The length of the tongue 74 is sufficient to engage the bottom of the channel 31 and urge the side rail into the corner of the L-shaped flanges 71. Each load supporting member 57, when perpendicularly aligned to the side rails, can be slid along the length of the side rails 23, 24, it being understood that the legs 73 and 67 of the flanges 71 and 64, respectively, grip over the outer upper and lower edges of the side rails as the relative sliding movement occurs. As one load supporting member engages the next mutually adjacent load supporting member, the tongues 77 and 78 will become interleaved between each other as is shown in FIG. 4. The tabs 77 and 78 are oriented so that the assembler need not be concerned about which edge of each load supporting member 57 should slid onto the side rails. The side rails 23, 24 have a length that corresponds to the length of a smaller platform section 12A, 12B, 13A or 13B, namely, to six load supporting members 57 and one load supporting member 58 (which will be described below) mounted edge-to-edge as shown in FIGS. 2 and 4. In other words, the terminal ends of the side rails 23, 24 correspond with the terminal ends of the platform sections 12A, 12B, 13A, 13B.

The load supporting member 58 is virtually identical to the load supporting member 57 and, accordingly, the same reference numerals used for describing the structure of the load supporting member 57 are used in the drawings illustrating the load supporting member 58. Accordingly, further detailed discussion concerning the construction of the load supporting member 58 is deemed unnecessary. The only difference that exists between a load supporting member 57 and a load supporting member 58 is that there are no tabs projecting from one edge, namely, the edge 81 as shown in FIG. 2, of the load supporting member 58. The other edge 82 of the load supporting member 58 is identical to the edge of a load supporting member 57 having the tabs 77 projecting therefrom as shown in FIG. 4. If the lowermost step of the stair step assembly 11 has only one load supporting member, no tabs need be provided on either edge to form a further load supporting member 58A.

Figure 9:
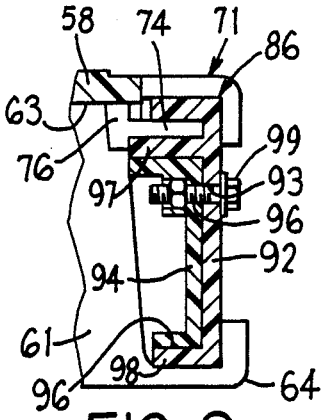
FIG. 9 is a sectional view taken along the line 9—9 of FIG. 8.
Figure 8:
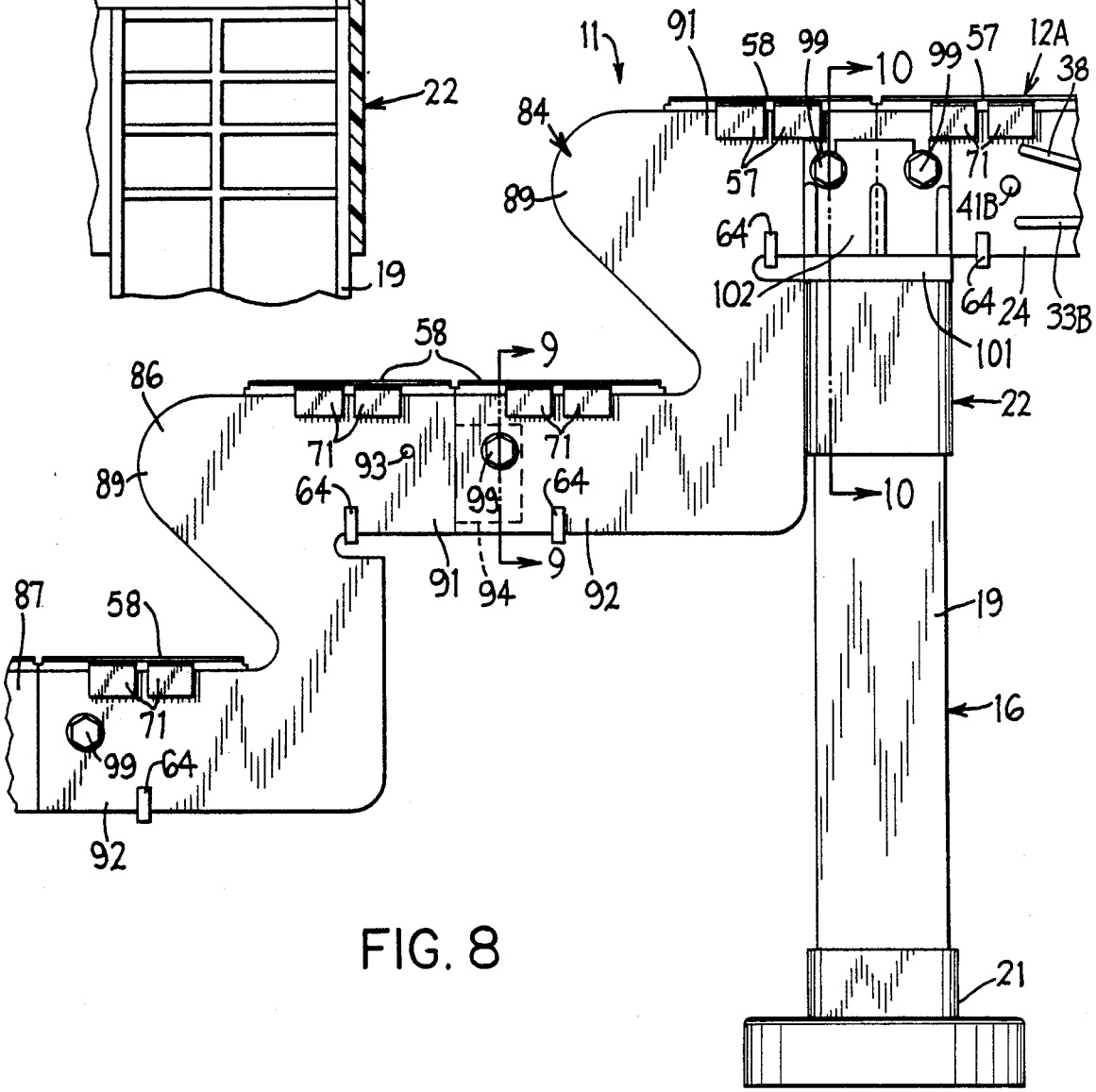
FIG. 8 is an enlarged side view of the stair step assembly shown at the left end of the platform assembly illustrated in FIG. 1.

The platform section 11 is, as has been stated above, a stair step assembly. An enlarged side view of the stair step assembly is illustrated in FIG. 8. Like the larger platform sections 12 and 13, the platform section 11 is comprised of a plurality of smaller stair step sections 84, 86 and 87 and each of these sections has a pair of left and right hand side rails 88 and 89, respectively. Each of the side rails 88, as well as the side rails 89, are identical to each other and have a generally Z-shaped profile when viewed from the side. The side rails 88 and 89 are mirror images of each other. The upper and lower horizontally extending legs 91 and 92 of the Z-shaped profile of the side rails 89 have a cross sectional shape identical to the cross sectional shape of the side rail 24. However, since the side rail 24 is identical to the side rail 23, its cross sectional profile is identical to the cross sectional profile of the side rail 23 as illustrated in FIG. 6. Thus, the cross sectional profile of the legs 91 and 92 of the side rails 89 are of an identical E-shaped profile (as illustrated in FIG. 9) as the E-shaped profile 23 shown in FIG. 6. As a result, a load supporting member 58 is allowed to slide onto the legs 91 and 92 and be intimately secured thereto in the same manner as has been described with respect to the load supporting members 57, 58 and their relationship to the side rails 23, 24. No tabs 77 or 78 confront the person using the stair step assembly 11. Therefore, further discussion in this regard is deemed unnecessary.

Each side rail 88, 89 has at least one bolt hole 93 adjacent the terminal end of each leg. As shown in FIG. 8, each side rail also has an extension 94 which projects beyond the terminal end of the upper leg 91 of each of the side rail sections 84, 86 and 87. The extension also has a bolt hole 96 (FIG. 9) therein and is adapted to be aligned with the bolt hole 93 in the next adjacent leg 92 of the next adjacent side rail. The cross sectional shape of the extension 94 corresponds to the cross sectional shape of the channel 96 defined between the legs 97 and 98 in the legs 91 and 92 of each of the side rail sections. The extension 94 is received into the channel 96 until the bolt holes 93 and 96 become aligned after which a fastener member 99 can be received and fixedly secured therein to hold the stair step sections together as well as holding the stair step assembly 11 to a terminal end of the platform assembly 10 as illustrated in FIG. 1.

Figure 10:
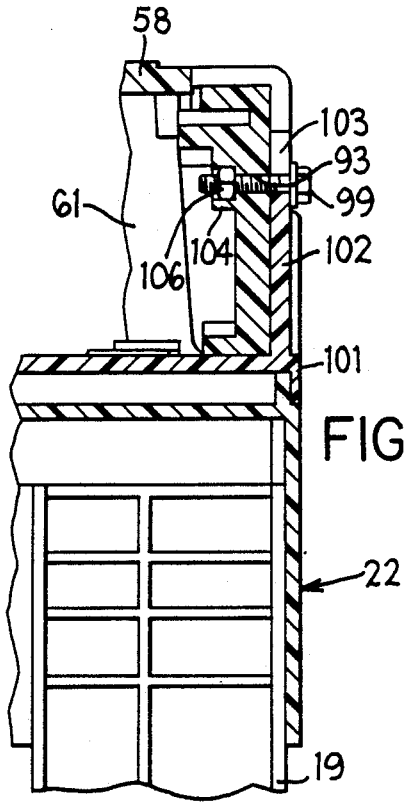
FIG. 10 is a sectional view taken along the line 10—10 of FIG. 8.

The height or level adjusting device 22 has a cross piece support member 101, at each of the ends of which is provided an upstanding attachment plate 102. A plurality of notches 103 are provided in the upper edge of the attachment plate 102 and are adapted to receive the shanks of bolts 99 received in the respective bolt holes 93 in the side rails 88 and 89 of the stair step section 84. If desired, an embossment 104 can be provided around the bolt hole 93 in the upper leg 91 of each of the stair step sections as shown in FIG. 10 to captively hold a nut 106 therein. The portion of the shanks of the two fastener elements 99 are spaced the same distance apart as are the notches 103 so as to facilitate a reception of the corresponding shanks of the fastener members 99 therein to effect a securement and a holding of the upper end of the stair step section 11 to the terminal end of the platform assembly 10. Further details of this connection are set forth in a copending application Ser. No. 07/446,920 entitled HEIGHT OR LEVEL ADJUSTING DEVICE FOR PLATFORM ASSEMBLY, filed Dec. 6, 1989 further details of the design of the stair step assembly are illustrated in a copending design application Ser. No. 07/447,916 entitled STAIR STEP ASSEMBLY, filed Dec. 6, 1989.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A platform assembly, comprising:

a pair of separate laterally spaced and parallel side rails having a generally flat plate-like profile which is generally vertically aligned, said plate-like profile having at least three mutually parallel leg portions extending transversely thereto and oriented so as to face the leg portions on the other of said side rails, a first and second one of said three leg portions being spaced so as to define a first channel, the space between said second and a third one of said three leg portions defining a second channel;

at least one elongated load supporting means connected to and extending between said side rails, said load supporting means having a load supporting surface on a top surface thereof and, at opposite longitudinal ends of said load supporting means, at least a pair of L-shaped flanges, a first of said flanges being adjacent said top surface, while a second of said flanges being adjacent a bottom of said load supporting means, first legs of said first and second flanges extending parallel to said load support surface and away from said longitudinal ends, second legs of said first and second flanges extending generally perpendicular to said first legs adjacent an end of said first legs remote from said load supporting means, said second legs being coplanar and extending toward one another from their respective first flanges, and at least one elongated tongue extending away from said longitudinal ends of said load supporting means and parallel to said first legs, said tongues being intermediate said first legs, said load supporting means being coupled to said side rails by first orienting the longitudinal axes of said load supporting means and said side rails perpendicular to each other and then sliding said load supporting means onto said side rails, said tongues being received in said first channels, said L-shaped flanges gripping around upper and lower edges of said side rails so that said second flanges are oriented on a side of each of said side rails remote from load supporting means extending therebetween.

2. The platform assembly according to claim 1, wherein a pair of platform sections are provided and are joined together end-to-end;

wherein a first elongated fishplate is provided and is received in said second channels of said side rails of both platform sections; and wherein fastening means are provided for fastening each said first fishplate to said side rails of both said platform assemblies.

3. The platform assembly according to claim 2, wherein a second elongated fishplate is provided on a side of said side rails remote from said first fishplate.

4. The platform assembly according to claim 3, wherein each said side rail has means defining a third channel on a side of said side rails opposite said first and second channels, said second fishplate being received in said third channel means.

5. The platform assembly according to claim 1, wherein each supporting surface is defined by a plate having a predetermined thickness and a pair of edges which extend parallel to the longitudinal axis of said load supporting means;

wherein a plurality of laterally spaced tabs are provided which project away from both of said edges of a plurality of said load supporting means in a direction perpendicular to said longitudinal axis of said load supporting means, said tabs each projecting from a downwardly facing surface on said load supporting means which is below said loading supporting surface and have an upwardly facing surface that projects beneath said downwardly facing surface on the next adjacent load supporting means, said upwardly facing surface of said tabs each engaging said downwardly facing surface on a next adjacent load supporting means.

6. The platform assembly according to claim 5, wherein said tabs on one load supporting means is interleaved between the tabs on the next adjacent load supporting means.

7. The platform assembly according to claim 5, wherein said plate of each load supporting means includes reinforcing means on said downwardly facing surface.

8. The platform assembly according to claim 1, wherein height or level adjusting means are provided at at least one end of said platform sections.

9. The platform assembly according to claim 8, wherein said height or level adjusting means includes means for connecting a pair of platform assemblies end-to-end.

10. The platform assembly according to claim 1, wherein said side rails extend lengthwise in an S-shaped pattern, one end of each S-shaped pattern having an end projection thereon adapted to be received in said second channel of said side rails so as to facilitate a plurality of S-shaped patterns being connected end-to-end, each S-shaped side rail having at least a pair of vertically offset, horizontally extending, sections adapted to receive thereon at least one of said load supporting means to thereby form a stair step structure.

11. The platform assembly according to claim 10, wherein each supporting surface is defined by a plate having a predetermined thickness and a pair of edges which extend parallel to the longitudinal axis of said load supporting means; and wherein a plurality of laterally spaced tabs are provided which project away from both of said edges of a plurality of said load supporting means in a direction perpendicular to said longitudinal axis of said load supporting means, said tabs each projecting from a downwardly facing surface on said load supporting means which is below said load supporting surface and have an upwardly facing surface that projects beneath said downwardly facing surface on the next adjacent load supporting means, said upwardly facing surface of said tabs each engaging said downwardly facing surface on load supporting means.

12. The platform assembly according to claim 11, wherein an edge of said plate oriented on an upper one of said horizontally extending sections is free of tabs projecting therefrom.

* * * * *